US007119647B2

(12) United States Patent
Park

(10) Patent No.: US 7,119,647 B2
(45) Date of Patent: Oct. 10, 2006

(54) METHOD AND APPARATUS FOR SUBSTANTIALLY REDUCING ELECTRICAL EARTH DISPLACEMENT CURRENT FLOW GENERATED BY WOUND COMPONENTS WITHOUT REQUIRING ADDITIONAL WINDINGS

(75) Inventor: Chan Woong Park, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 0 days.

(21) Appl. No.: 10/324,492

(22) Filed: Dec. 19, 2002

(65) Prior Publication Data

US 2003/0122646 A1 Jul. 3, 2003

Related U.S. Application Data

(60) Provisional application No. 60/342,677, filed on Dec. 21, 2001.

(51) Int. Cl.
*H01F 27/02* (2006.01)

(52) U.S. Cl. ..... 336/84 C

(58) Field of Classification Search ..... 336/69, 336/84 R, 84 C, 180–183, 220–221; 323/355–358
See application file for complete search history.

(56) References Cited

U.S. PATENT DOCUMENTS

| | | | | |
|---|---|---|---|---|
| 2,553,324 | A * | 5/1951 | Lord | 336/73 |
| 3,299,384 | A * | 1/1967 | Lee | 336/171 |
| 3,810,303 | A | 5/1974 | Hoell | |
| 4,089,049 | A | 5/1978 | Suzuki et al. | |
| 4,518,941 | A * | 5/1985 | Harada | 336/69 |
| 4,707,619 | A | 11/1987 | Chu et al. | |
| 5,150,046 | A * | 9/1992 | Lim | 323/356 |
| 5,615,091 | A | 3/1997 | Palatnik | |
| 6,366,474 | B1 | 4/2002 | Gucyski | |
| 6,429,763 | B1 | 8/2002 | Patel et al. | |
| 6,549,431 | B1 | 4/2003 | Odell et al. | |

FOREIGN PATENT DOCUMENTS

| | | | |
|---|---|---|---|
| JP | 60-226112 | * | 11/1985 |
| JP | 60226112 | | 11/1985 |
| JP | 04-282806 | * | 10/1992 |
| JP | 0737477 A | | 2/1995 |
| JP | 10052036 | | 2/1998 |
| JP | 11-186068 | * | 7/1999 |

* cited by examiner

*Primary Examiner*—Tuyen T Nguyen
(74) *Attorney, Agent, or Firm*—Blakely Sokoloff Taylor & Zafman LLP

(57) ABSTRACT

An energy transfer element having an energy transfer element input winding and an energy transfer element output winding. In one aspect, the energy transfer element input winding is capacitively coupled to the energy transfer element output winding. The energy transfer element is capacitively coupled to electrical earth. Capacitive displacement current between the energy transfer element input winding and energy transfer element output winding is substantially reduced by balancing the relative electrostatic fields generated between these windings and/or between the energy transfer element and electrical without any additional windings.

24 Claims, 7 Drawing Sheets

METHOD AND APPARATUS FOR SUBSTANTIALLY REDUCING ELECTRICAL EARTH DISPLACEMENT CURRENT FLOW GENERATED BY WOUND COMPONENTS WITHOUT REQUIRING ADDITIONAL WINDINGS

RELATED APPLICATION

This application claims priority to U.S. provisional application Ser. No. 60/342,677, filed Dec. 21, 2001, entitled "Method And Apparatus For Substantially Reducing Electrical Earth Displacement Current Flow Generated By Wound Components Without Requiring Additional Windings."

BACKGROUND OF THE INVENTION

1. Field of the Invention

The present invention relates generally to energy transfer elements and, more specifically, the present invention relates to energy transfer elements having at least 2 windings.

2. Background Information

FIG. 1 shows an outline schematic diagram of a flyback converter power supply 101. The basic operation of the flyback converter 101 power supply is well documented and known to one skilled in the art. The primary switch 103 is controlled through a feedback control signal 105, typically but not necessarily from the secondary of the power supply as shown. The energy transfer element or transformer 107 windings have a dot polarity that is used to indicate the phase relationship of the winding voltages. During voltage transitions across the windings, the dot end of the windings are in phase.

FIG. 2 is a schematic of a power supply 201, which expands on the outline schematic of FIG. 1 by representing the parasitic capacitances 209 that exist between the transformer body or structure (energy transfer element) and electrical earth, the parasitic capacitances 211 that exist between the input and output windings and the transformer body (core) and also the parasitic capacitances 213 that exist between the input and output windings of the transformer. Usually the transformer core is the ferrite core used in the transformer construction to provide a low reluctance path for the magnetic flux coupling input and output windings of the transformer 207. As noted in FIG. 2, the parasitic capacitance 215 between the output of the transformer and electrical earth in some cases maybe be short circuited depending on the application and or the way in which the electrical noise measurements are made.

During the normal operation of the power supply 201, the voltages across both input and output windings of the transformer 207 transition in accordance with the standard flyback converter power supply operation. These transitions generate displacement currents in the electrical earth through the various parasitic capacitances 209, 211, 213 and 215 shown. These displacement currents are detected as common mode noise (or emissions) and measured by a piece of test equipment called a Line Input Stabilization Network (LISN). The configuration and connection of this equipment is well documented and known to one skilled in the art.

FIG. 2 also highlights capacitor Cy 217 which is a Y-capacitor, that is commonly used in switching power supplies to reduce the common mode emissions. This component, capacitor Cy 217, provides a low impedance path for displacement currents flowing between input and output windings of the transformer 207, to return to their source without flowing through electrical earth. The currents in capacitor Cy 217 are not detected by the LISN and its use therefore acts to reduce common mode emissions.

SUMMARY OF THE INVENTION

An energy transfer element having an energy transfer element input winding and an energy transfer element output winding is disclosed. In one aspect, the energy transfer element input winding is capacitively coupled to the energy transfer element output winding. The energy transfer element is capacitively coupled to electrical earth. Capacitive displacement current between the energy transfer element input winding and energy transfer element output winding and the energy transfer element and electrical earth is substantially reduced by balancing the relative electrostatic fields generated between these windings and/or between the energy transfer element and electrical earth. In one embodiment, this is achieved through the selection of the physical position and number of turns in a part of one of the existing energy transfer element windings and therefore requires no additional windings.

In one embodiment, an energy transfer element according to the teachings of the present invention includes an energy transfer element input winding and an energy transfer element output winding. The energy transfer element input winding is capacitively coupled to the energy transfer element output winding. The energy transfer element is coupled to electrical earth and the energy transfer element input and output windings are wound to substantially reduce displacement current flowing between the energy transfer element and electrical earth without requiring any additional windings. In one embodiment, the energy transfer element is a flyback transformer. In one embodiment, the energy transfer element is a forward converter transformer used in a forward converter power supply.

In another embodiment, an energy transfer element according to the teachings of the present invention includes an energy transfer element input winding and an energy transfer element output winding. The energy transfer element input winding is capacitively coupled to the energy transfer element output winding. The energy transfer element input and output windings are wound to substantially reduce capacitive displacement current between them without requiring any additional windings. In one embodiment, the capacitively coupled displacement currents are substantially reduced by balancing the relative electrostatic fields generated between these windings. In one embodiment, the energy transfer element is a flyback transformer. In one embodiment, the energy transfer element is a forward converter transformer used in a forward converter power supply.

In yet another embodiment, a flyback converter power supply according to the teachings of the present invention includes two input voltage terminals and an energy transfer element having an energy transfer element input winding and an energy transfer element output winding. The energy transfer input winding is coupled to one input voltage terminal and to one terminal of a switch. A second terminal of the switch coupled to the other input terminal. A third terminal of the switch coupled to control circuitry. The energy transfer element input winding is capacitively coupled to the energy transfer element output winding. The energy transfer element input and output windings are wound to substantially reduce capacitive displacement current between them without requiring any additional windings.

In still another embodiment, a method according to the teachings of the present invention includes winding an energy transfer element having an energy transfer element input winding and an energy transfer element output winding such that the capacitively coupled displacement currents flowing between the energy transfer element input winding and energy transfer element output winding are substantially reduced without requiring any additional windings.

In another embodiment, an energy transfer element according to the teachings of the present invention includes an energy transfer element input winding and an energy transfer element output winding. The energy transfer element input winding is capacitively coupled to the energy transfer element output winding. The energy transfer element input and output windings are wound to substantially reduce capacitive displacement current between them by using a balancing winding, which is included as a part or portion of the energy transfer element input winding or a part or portion of the energy transfer element output winding. In one embodiment, the balancing winding portion is included a layer of the input winding. In one embodiment, the layer of the input winding including the balancing winding portion is a layer closest to the output winding. In another embodiment, the balancing winding portion is included a layer of the output winding. In one embodiment, the layer of the output winding including the balancing winding portion is a layer closest to the output winding. In one embodiment, the number of turns of the balancing portion of the input or output winding is chosen to balance electrostatic fields generated between the energy transfer element windings. In one embodiment, the balancing portion is wound to provide coverage of the available winding area. In one embodiment, the balancing portion is wound to provide coverage of the available winding area by using one or more wires in parallel or by choosing an appropriate wire gauge. In one embodiment, the energy transfer element is a flyback transformer. In one embodiment, the energy transfer element is a forward converter transformer. Additional features and benefits of the present invention will become apparent from the detailed description and figures set forth below.

BRIEF DESCRIPTION OF THE DRAWINGS

The present invention detailed illustrated by way of example and not limitation in the accompanying figures.

DETAILED DESCRIPTION

Figure 1:
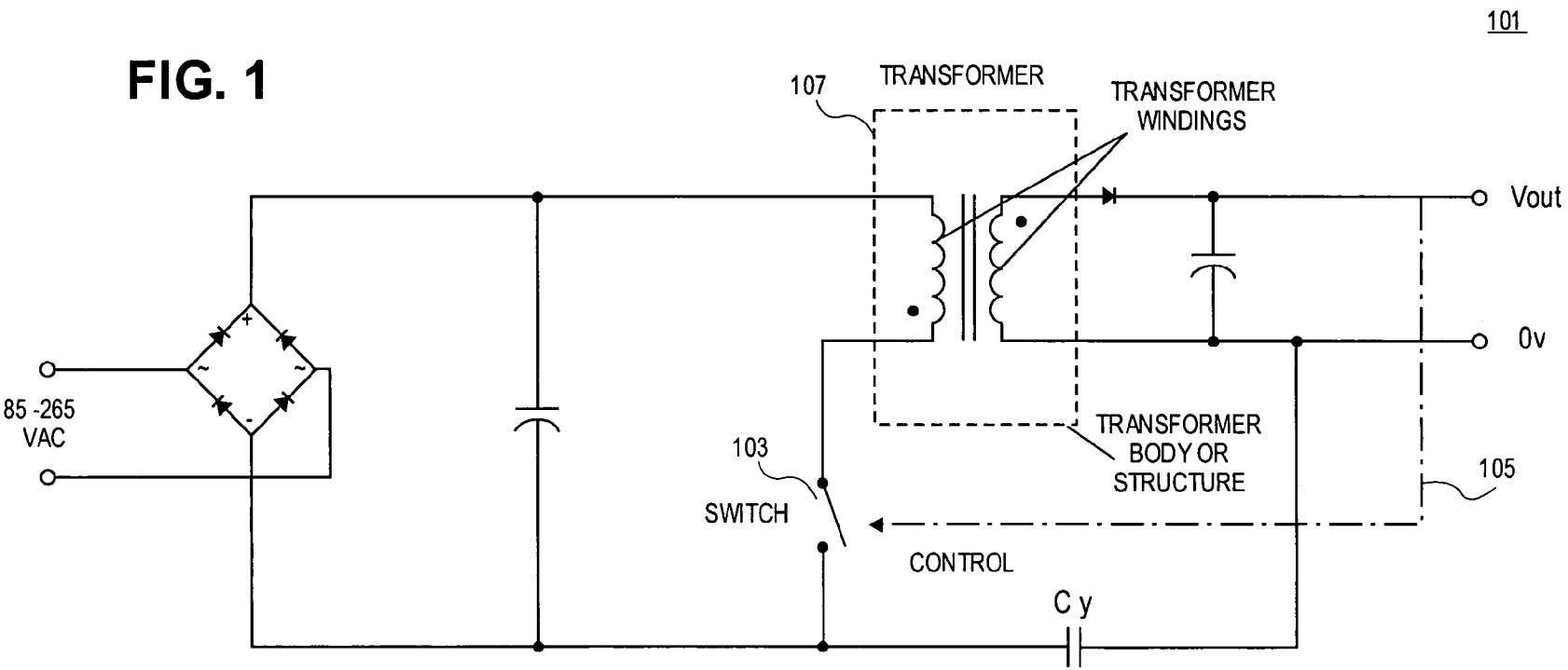
FIG. 1 is a schematic diagram of a flyback converter power supply.
Figure 2:
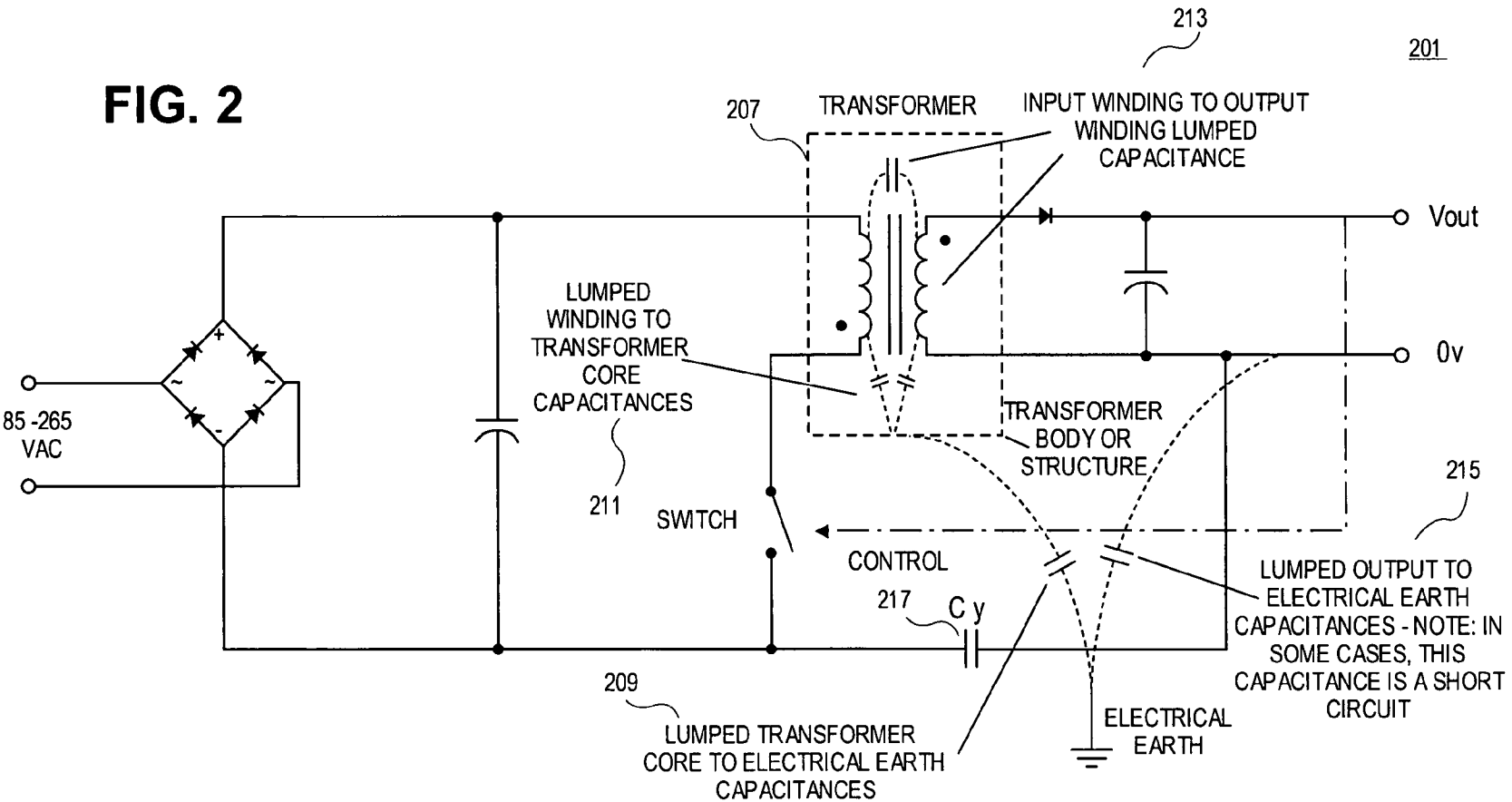
FIG. 2 is a schematic diagram of a flyback converter power supply showing parasitic capacitances.

Embodiments of methods and apparatuses for reducing electrical earth displacement current flow generated by wound components are disclosed. In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Causes of electrical noise generated by switching power supply circuits are well documented and known to those skilled in the art. This invention specifically deals with the reduction in common mode noise generated by the energy transfer element, commonly referred to as the power supply transformer, during the operation of a switching power supply.

Since these techniques can be applied to flyback and forward converter power supplies, it is more accurate to refer to the transformer as the energy transfer element. However in the specific embodiment discussed here, a flyback circuit example is discussed and the energy transfer element is referred to as a transformer.

Various embodiments of the present invention described in herein provide techniques that are used in the construction of a transformer to substantially reduce the electrical earth currents generated by the power supply allowing the system cost to be reduced either by eliminating the requirement to use a Y-capacitor or by reducing the value of Y capacitor necessary. Reducing the value of or eliminating the Y capacitor also reduces leakage currents between the safety isolated output and the AC input line. This is advantageous in applications where the output can come in contact with the user such as for example but not limited to cellular phone applications or the like.

In particular, various embodiments of the techniques described herein substantially reduce the capacitive displacement currents that normally flow in a switching power supply between the primary and secondary, or input and output, windings, and the core of the transformer and electrical earth. In one embodiment, the reduction is achieved without the addition of windings in the transformer. Instead, in one embodiment the last layer of the input winding is wound in order to balance the differential electrostatic fields generated between the transformer input winding and the transformer output winding. These electrostatic fields normally create displacement currents that require extra measures, such as for example additional transformer windings or external components to avoid these displacement currents interfering with other equipment. Various embodiments of the present invention therefore reduce system cost by eliminating certain power supply components or additional transformer windings that would otherwise be necessary to a designer not having the benefit of this disclosure.

As an overview, displacement currents generated by the operation of a switching power supply and flowing to electrical earth, are measured as electrical noise, also known as common mode emissions, that can cause electromagnetic interference (EMI) which influences other equipment. It is therefore necessary to maintain these currents below published limits set up by regulatory bodies globally. Transformers in switching power supplies generate displacement current flow to electrical earth in two ways.

One of the ways is the flow of displacement current between the core of the transformer and electrical earth. This current is generated by voltage transitions on the transformer windings coupling capacitively to the core of transformer. This current then typically flows capacitively through free space between the core of the transformer and electrical earth.

The other way is the flow of displacement current between the primary and secondary windings of the transformer, which are set up by differential voltages between these windings. Differential voltages between these windings generate current flow in the inter-winding capacitance. This displacement current will return to its source through parallel paths one of which is electrical earth.

Various embodiments of the present invention describe the use existing windings within the transformer construction that employ the natural voltage fluctuations of the transformer windings to balance and cancel the relative electrostatic fields between the input and output windings that arise during the switching power supply operation. In one embodiment, the design of these existing windings is specific to a particular transformer both in terms of the number of winding layers, turns used and their physical positioning. Through use of these techniques, the displacement current flow between the transformer windings and transformer physical structure to electrical earth is substantially reduced. This in turn eliminates or reduces the cost of external components such as Y capacitors that are used to reduce common mode emissions.

Figure 3B:
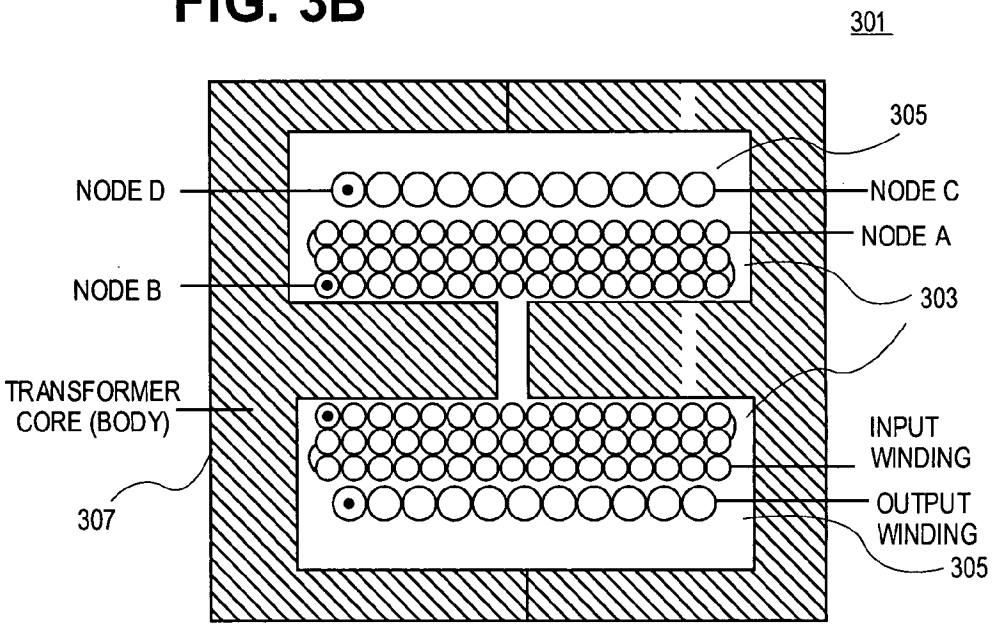
FIG. 3B is a cross section of a layer wound flyback transformer.
Figure 3A:
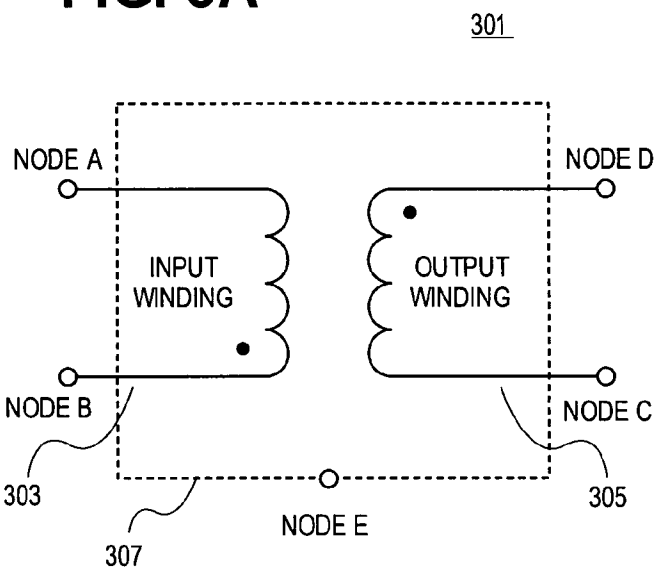
FIG. 3A is a schematic diagram of a transformer.

To illustrate, FIGS. 3A and 3B show simple outline schematic and cross-sections views of a transformer 301. The two ends of the input winding 303 are labeled nodes A and B. The two ends of the output winding 305 are labeled nodes C and D. For the purposes of this description, the physical core 307 of the transformer is labeled as a further node E. The dot polarity of the windings 303 and 305 is such that when there is a voltage transition on the input winding 303 such that node B is becoming more positive relative to node A, the voltage of node D will increase relative to node C.

As described above, these voltage transitions generate displacement currents in the parasitic capacitances resulting in current flowing to electrical earth. As will be discussed, design of these existing windings is provided in one embodiment of the present invention to substantially reduce these electrical earth currents.

Figure 4B:
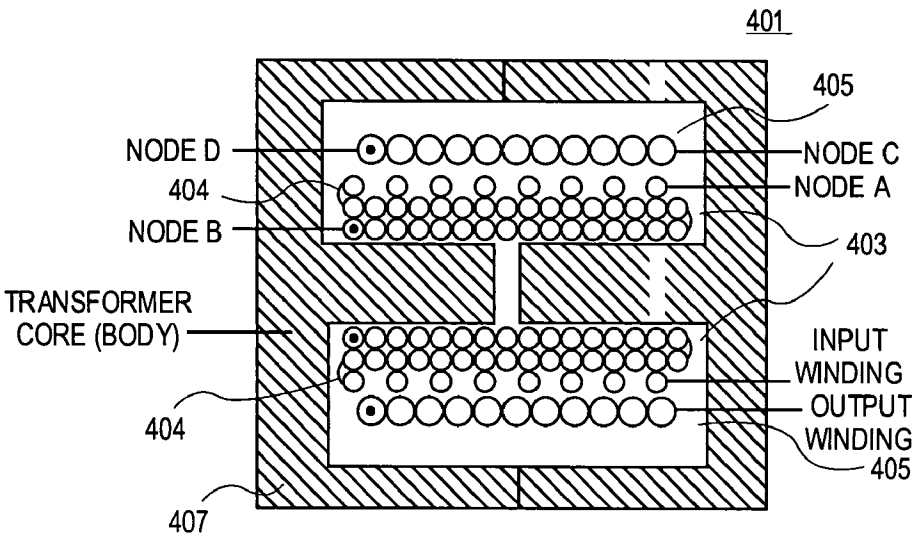
FIG. 4B is a cross section of one embodiment of a transformer wound in accordance with the teachings of the present invention.
Figure 4A:
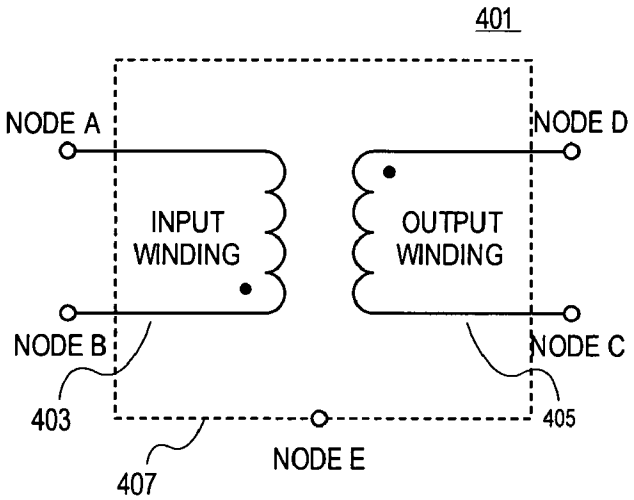
FIG. 4A is a schematic diagram of one embodiment of a transformer wound in accordance with the teachings of the present invention.

FIG. 4A shows the schematic of one embodiment of a transformer 401 wound in accordance with the present invention. Transformer 401 may be a flyback transformer, a forward converter transformer or the like. Schematically the transformer appears to be identical to the transformer schematic in FIG. 3A. For instance, the two ends of the input winding 403 are labeled nodes A and B. The two ends of the output winding 405 are labeled nodes C and D. For the purposes of this description, the physical core 407 of the transformer is labeled as a further node E. The dot polarity of the windings 403 and 405 is such that when there is a voltage transition on the input winding 403 such that node B is becoming more positive relative to node A, the voltage of node D will increase relative to node C.

However, FIG. 4B shows the cross section of one embodiment of the transformer 401. Here it can be seen in the illustrated embodiment that the number of turns of the outer layer 404 of the input winding 403 of transformer 401 is lower than the previous, inner or non-outer, layers of input winding 403, even though the number of layers has not changed from the cross section of input winding 303 of transformer 301 shown in FIG. 3B. As can be observed in FIG. 4B, the outer layer 404 of input winding 403 is the layer of input winding 403 that is wound closest to output winding 405.

To a first order, if the number of turns of the output winding 405 is identical to the number of turns of the outer layer 404 of the input winding 403, the electrostatic fields produced by each will balance to eliminate or substantially reduce displacement currents in one embodiment. This first order analysis is strongly influenced by other factors such as the electrostatic field produced by inner layers of the input winding and displacement currents generated by the input winding capacitively coupling from the transformer core to the output winding. In practice, the outer layer of a primary winding normally has many more turns than the output winding of the transformer. It is for this reason that the previous solutions to reduce displacement current use a separate balancing or shield winding between the input and output windings to reduce displacement currents.

In various embodiments of the present invention, a balancing or shield winding may be a part or portion of the main input or output winding of the transformer. In the output winding embodiment, the number of turns of the input winding is substantially equal to the number of turns of the inner layer of the output winding such that the electrostatic fields produced by each will balance to eliminate any displacement currents. In one embodiment, the exact number of turns may be chosen using empirical methods to determine the optimum balancing of electrostatic fields produced by both input and output windings. In this embodiment, the balancing layer of the output winding is the layer wound closest to the input winding. In many practical energy transfer element designs, there is more than one output winding to support different output voltages as required by the specific application. In these multiple output designs, the layer of the output winding wound closest to the input winding is again the layer used to provide balancing of the electrostatic fields produced by the input and output windings in accordance with the teachings of the present invention. These various embodiments have an advantage of retaining close magnetic coupling (low leakage inductance)

between these windings, which is normally reduced when a separate balancing or shield winding is introduced in this position.

The practical implementation of these various embodiments in accordance with the teachings of the present invention in which the main input or output windings include a balancing or shield winding portion depends partly on the number of winding turns in the transformer. Furthermore, other influences such as capacitively coupled displacement currents from the transformer core coupling to the output winding which originate from the input winding coupling displacement currents to the core and capacitively coupled displacement currents from inner layers of the input winding coupling directly to the output winding, make it desirable to have fewer turns in the outer layer of the input winding than the theory would suggest to provide a net balance of the electrostatic fields between input and output windings of the transformer. As such it is often necessary to construct the outer layer of the input winding from two or more parallel wires of a gauge chosen to insure good coverage of the winding area available in the transformer. This reduces the influence of inner layers of the input winding by maintaining the physical separation between these inner layers and the output winding across the whole winding area.

Figure 5B:
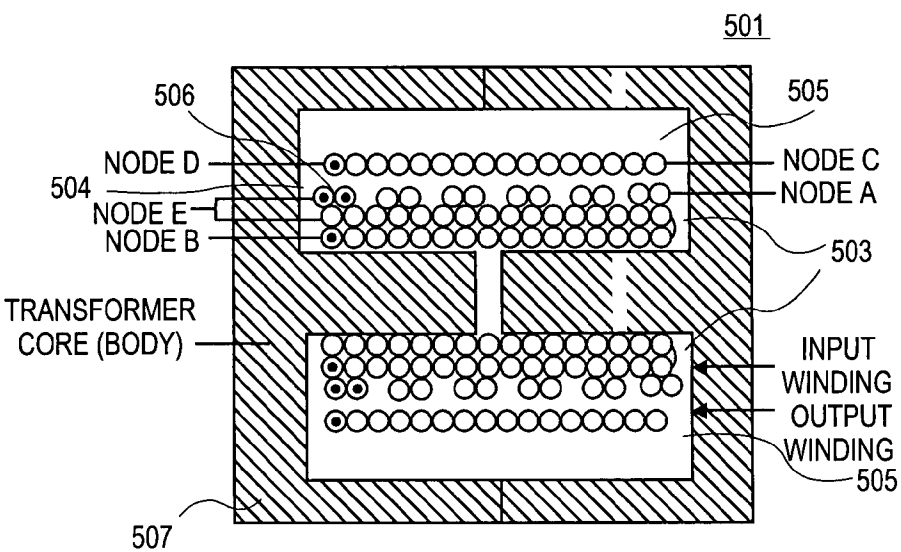
FIG. 5B is a cross section of the embodiment shown in FIG. 5A of a transformer wound in accordance with the teachings of the present invention.
Figure 5A:
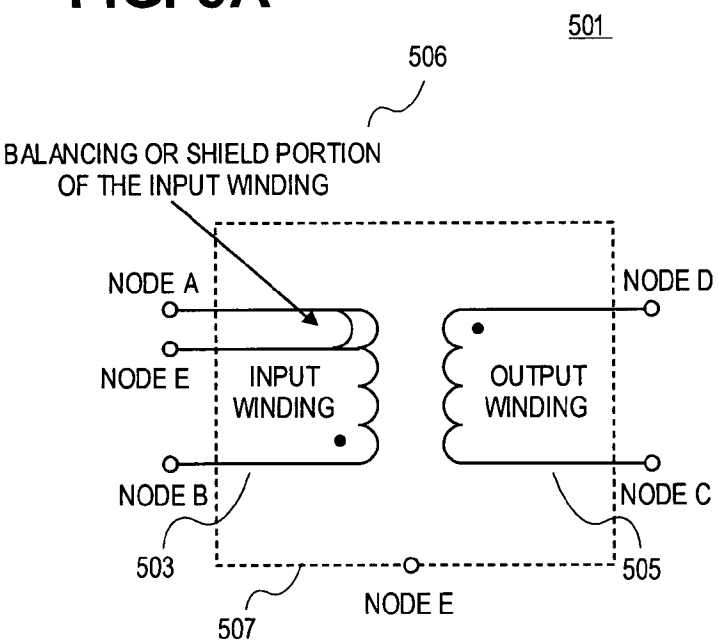
FIG. 5A is a schematic diagram of another embodiment of a transformer wound in accordance with the teachings of the present invention.

To illustrate, FIG. 5A is a schematic of one embodiment of a transformer 501 in accordance with the teachings of the present invention where the input winding 503 includes balancing or shielding winding portion 506. As shown in the illustrated embodiment, a final layer 504 of an input winding 503 is therefore wound with two parallel wires, which includes the balancing or shielding winding portion 506. Node E is the physical termination of the first layers of the input winding 503, which is helpful in the practical construction of the transformer 501. In particular, this helps allow the final layer 504 of the input winding 503 to be started using two parallel wires including the balancing or shielding winding portion 506 instead of the single wire used in the previous layers of input winding 503. Node E is, however, only a termination and start point and does not need to be electrically connected to any circuitry outside the transformer. Indeed, the input winding 503 nodes A and B are the connections to the external power supply circuit, which means that all layers of the input winding 503, including the balancing or shielding winding portion 506, are connected in series. Thus, all conduct the main input winding 503 current and therefore form part of the same input winding 503. The final layer 504 of the input winding 503 includes the balancing or shield portion 506 of the input winding 503.

FIG. 5B shows a cross section of one embodiment of this transformer 501 where again the final layer 504 of input winding 503 is wound with two parallel wires including the balancing or shielding winding portion 506 of input winding 503 to cover the available winding area effectively. This parallel balancing or shielding winding portion 506 is indicated in FIGS. 5A and 5B by showing the dot polarity of this outer layer 504 in two adjacent conductors. For clarity the last or final layer 504 of input winding 503 is shown in the embodiment illustrated in FIG. 5B with spacing between the adjacent parallel turns. It is appreciated, however, in practice that the optimum balancing performance of this layer is likely to be gained by winding the parallel wires tightly together to cover the complete winding area. More parallel wires can be used in other embodiments depending on the particular transformer design. As described above, this outer or final layer 504 still conducts the full input winding 503 current and is therefore an integral part of the main input winding 503 of the transformer 501 retaining the fact that no additional or separate windings have been introduced to transformer 501. In one embodiment, the exact choice of the number of turns and wire gauge used in this outer layer of the input winding 503 is determined based on empirical optimization techniques. In the illustrated embodiment, output winding 505 is shown wound around outside input winding 503, which is wound around a physical core 507.

Factors influencing these choices include the physical spacing between layers and between the input and output winding in addition to both the input and output winding physical location relative to the transformer core. When perfect balancing of the electrostatic fields is achieved, the differential field between primary and secondary circuits is zero and the displacement current is also zero. In practice, the effect is to substantially reduce the net displacement current flowing in the electrical earth.

Figure 6A:
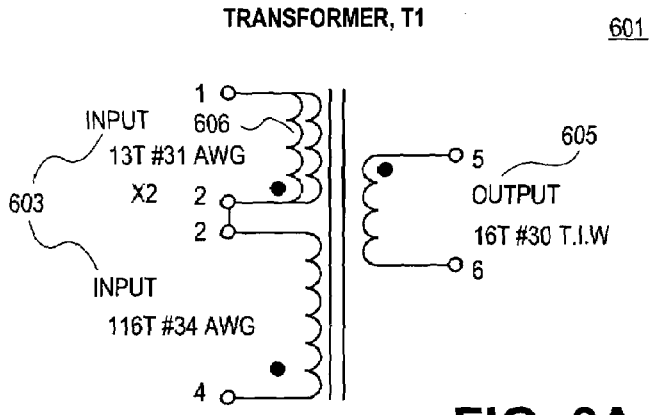
FIG. 6A is a schematic diagram of yet another embodiment of a transformer wound in accordance with the teachings of the present invention.
Figure 6B:
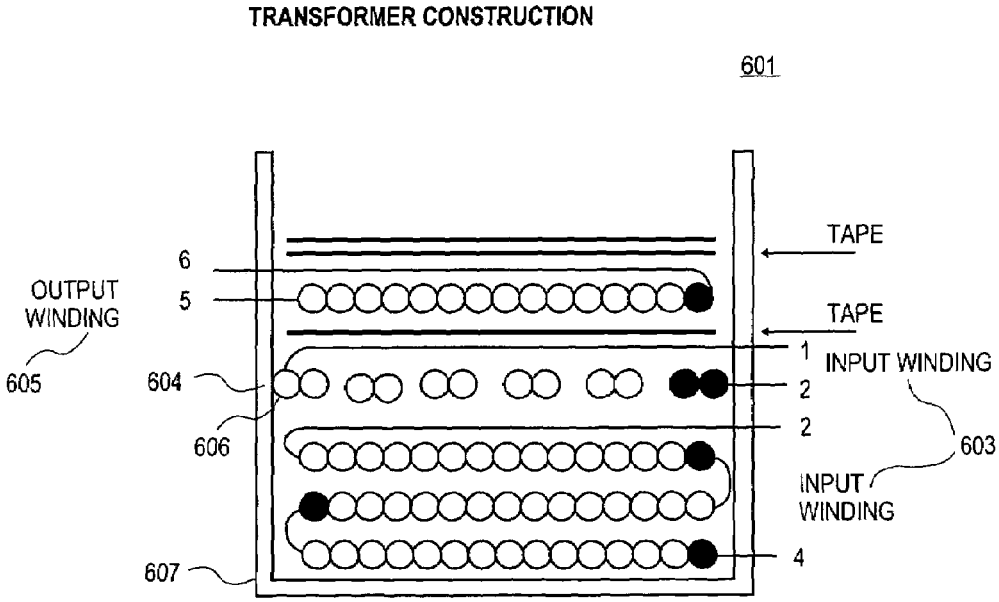
FIG. 6B is a cross section of the embodiment shown in FIG. 6A of a transformer wound in accordance with the teachings of the present invention.

FIGS. 6A and 6B show a specific schematic and cross-section view of one embodiment of a transformer 601 in accordance with the teachings of the current invention. As shown, transformer 601 includes an input winding 603 and an output winding 605 wound around a physical core 607. In one embodiment, the windings are wound onto a bobbin separating the windings from the magnetic core of the energy transfer element for safety reasons. For the purposes of clarity, the bobbin is not specifically shown but can be assumed to be part of the physical core 607 as necessary in a practical design. Table I below summarizes electrical specifications of transformer 601. In common with the embodiments shown in FIGS. 5A and B, the embodiments illustrated in FIGS. 6A and 6B show that input winding 603 also includes a balancing or shield winding portion 606. In the illustrated embodiment, the final layer 604 of input winding 603 includes two parallel wires, which include the balancing or shield winding portion 606 of the input winding 603. In the illustrated embodiment, this outer or final layer 604 is preceded by three inner layers of the input winding 603. It is appreciated of course that in other embodiments, different numbers of layers may be utilized for the input and output windings 603 and 605 in accordance with the teachings of the present invention.

In one embodiment, connections to external circuitry from input winding 603 are made with nodes 1 and 4, with node 2 not connected. In one embodiment, node 2 is simply representing a termination of the first three layers of the input winding 603 in order for the last layer 604 of input winding 603 to be started with two parallel wires including the balancing or shielding winding portion 606 of input winding 603. Note that in one embodiment, in addition to using two parallel wires this outer layer 604 of the input winding 603, a different wire gauge may be used in outer layer 604 than the three preceding layers of input winding 603. In one embodiment, this choice is made after the number of turns required in the outer layer 604 have been empirically determined to provide the optimum balancing effect. In one embodiment, once the number of turns have been chosen, the wire gauge is chosen such that the required number of turns completely fill the available winding area (or bobbin width).

Figure 7A:
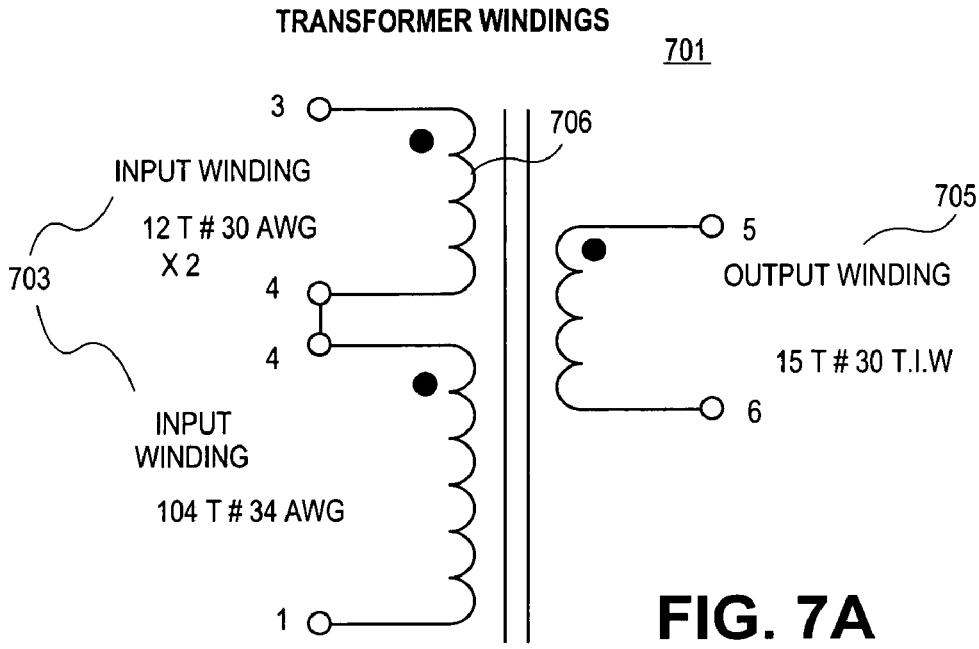
FIG. 7A is a schematic diagram of yet another embodiment of a transformer wound in accordance with the teachings of the present invention.
Figure 7B:
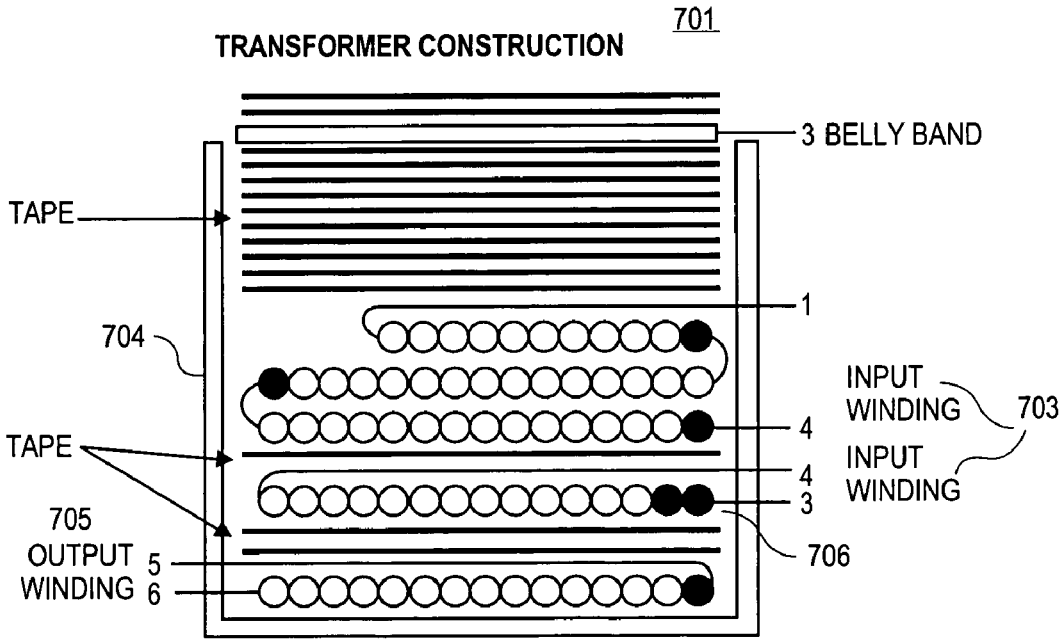
FIG. 7B is a cross section of the embodiment shown in FIG. 7A of a transformer wound in accordance with the teachings of the present invention.

FIGS. 7A and 7B show another specific schematic and cross-section view of one embodiment of a transformer 701 in accordance with the teachings of the current invention. As shown, transformer 701 includes an input winding 703 and an output winding 705 wound around a physical core 704. In common with the embodiments shown in FIGS. 5A and B, the embodiments illustrated in FIGS. 7A and 7B show that input winding 703 also includes a balancing or shield winding portion 706. In the illustrated embodiment, the first layer of input winding 703 includes two parallel wires, which include the balancing or shield winding portion 706 of the input winding 703. In the illustrated embodiment, this inner or first layer 706 is wound after the output winding 705 and before the remaining layers of the input winding 703. It is appreciated of course that in other embodiments, different numbers of layers may be utilized for the input and output windings 703 and 705 in accordance with the teachings of the present invention. In addition it is appreciated that in other embodiments, different numbers of parallel wires may be used in the balancing or shield winding 706 portion of input winding 703.

In one embodiment, connections to external circuitry from input winding 703 are made with nodes 1 and 3, with node 4 not connected. In one embodiment, node 4 is simply representing a termination of the balancing or shield layer 706 of the input winding 703 in order for the remaining layers of input winding 703 to be started with a single wire. Note that in one embodiment, in addition to using two parallel wires this balancing or shield portion 706 of the input winding 703, a different wire gauge may be used in this shield or balancing layer 706 than the remaining layers of input winding 703. In one embodiment, this choice is made after the number of turns required in the balancing or shielding layer 706 have been empirically determined to provide the optimum balancing effect. In one embodiment, once the number of turns have been chosen, the wire gauge is chosen such that the required number of turns completely fill the available winding area (or bobbin width).

TABLE I

| Electrical Specifications. | | |
|---|---|---|
| Electrical Strength | 60 Hz 1 minute, from Pins 1–4 to Pins 5–6 | 3000 Vac |
| Primary Inductance (Pin1 to Pin4) | All windings open | 3.15 mH +/− 7% at 42 KHz |
| Resonant Frequency | All windings open | 300 KHz (Min.) |
| Primary Leakage Inductance | Pins 5–6 shorted | 45 uH Max. |

What is claimed is:

1. An energy transfer element, comprising:

an energy transfer element core;

a first winding wound around the energy transfer element core, the first winding having a first end coupled to a first node and second end coupled to a second node;

a second winding wound around the energy transfer element core, the second winding having a first end coupled to a third node and a second end coupled to a fourth node, the first winding capacitively coupled to the second winding; and a balancing portion included between the first node and the second node in the first winding wound around the energy transfer element core to reduce substantially a capacitive displacement current flowing between the energy transfer element and electrical earth.

2. The energy transfer element of claim 1 wherein the balancing portion of the first winding is adapted to balance relative electrostatic fields generated between the energy transfer element and electrical earth to reduce said capacitive displacement current.

3. The energy transfer element of claim 1 wherein the first winding includes an energy transfer element input winding.

4. The energy transfer element of claim 1 wherein the first winding includes an energy transfer element output winding.

5. The energy transfer element of claim 1 wherein the balancing portion is one of a plurality of layers of the first winding.

6. The energy transfer element of claim 1 wherein the balancing portion is one of a plurality of layers of the first winding that is wound closest to the second winding.

7. The energy transfer element of claim 1 wherein a number of turns in the balancing portion of the first winding is chosen to balance relative electrostatic fields generated between the energy transfer element and electrical earth.

8. The energy transfer element of claim 1 wherein the balancing portion of the first winding is wound to provide coverage of an available winding area of the energy transfer element.

9. The energy transfer element of claim 8 wherein the balancing portion of said one of the first or second windings includes wires wound in parallel in the available winding area of the energy transfer element to cover the available winding area of the energy transfer element to balance relative electrostatic fields generated between the energy transfer element and electrical earth.

10. The energy transfer element of claim 8 wherein the balancing portion of said one of the first or second windings includes wires having a gauge chosen to cover the available winding area of the energy transfer element to balance relative electrostatic fields generated between the energy transfer element and electrical earth.

11. The energy transfer element of claim 1 wherein the energy transfer element is included in a flyback transformer.

12. The energy transfer element of claim 1 wherein the energy transfer element is included in a forward converter transformer.

13. An energy transfer element, comprising:

an energy transfer element core;

a first winding wound around the energy transfer element core, the first winding having a first end coupled to a first node and second end coupled to a second node;

a second winding wound around the energy transfer element core, the second winding having a first end coupled to a third node and a second end coupled to a fourth node, the first winding capacitively coupled to the second winding; and a balancing portion included between the first node and the second node in the first winding wound around the energy transfer element core to reduce substantially a capacitive displacement current flowing between the first and second windings.

14. The energy transfer element of claim 13 wherein the balancing portion of the first winding is adapted to balance relative electrostatic fields generated between the first and second windings to reduce said capacitive displacement current.

15. The energy transfer element of claim 13 wherein the first winding includes an energy transfer element input winding.

16. The energy transfer element of claim 13 wherein the first winding includes an energy transfer element output winding.

17. The energy transfer element of claim 13 wherein the balancing portion is one of a plurality of layers of the first winding.

18. The energy transfer element of claim 13 wherein the balancing portion is one of a plurality of layers of the first winding that is wound closest to the second winding.

19. The energy transfer element of claim 13 wherein a number of turns in the balancing portion of the first winding is chosen to balance relative electrostatic fields generated between the first and second windings.

20. The energy transfer element of claim 13 wherein the balancing portion of the first winding is wound to provide coverage of an available winding area of the energy transfer element.

21. The energy transfer element of claim 20 wherein the balancing portion of said one of the first or second windings includes wires wound in parallel in the available winding area of the energy transfer element to cover the available winding area of the energy transfer element to balance relative electrostatic fields generated between the first and second windings.

22. The energy transfer element of claim 20 wherein the balancing portion of said one of the first or second windings includes wires having a gauge chosen to cover the available winding area of the energy transfer element to balance relative electrostatic fields generated between the first and second windings.

23. The energy transfer element of claim 13 wherein the energy transfer element is included in a flyback transformer.

24. The energy transfer element of claim 13 wherein the energy transfer element is included in a forward converter transformer.

* * * * *